United States Patent [19]

Estok

[11] 4,155,278

[45] May 22, 1979

[54] SWIVEL HEAD REACTION BAR NUT RUNNER

[75] Inventor: Eugene M. Estok, Willowick, Ohio

[73] Assignee: Cooper Industries, Inc., Houston, Tex.

[21] Appl. No.: 830,694

[22] Filed: Sep. 6, 1977

[51] Int. Cl.[2] ..... B25B 17/00

[52] U.S. Cl. ..... 81/57.11; 81/57.31

[58] Field of Search ..... 81/57.14, 57.29, 57.30, 81/57.44, 57.11, 57.12, 57.13; 285/305, 276, 185; 74/751

[56] References Cited

U.S. PATENT DOCUMENTS

| | | | |
|---|---|---|---|
| 683,645 | 10/1901 | Gibbs | 285/276 |
| 1,762,515 | 6/1930 | Hiersch | 81/57.31 |
| 1,970,179 | 8/1934 | Miller | 81/57.14 |
| 3,456,964 | 7/1969 | Zierden | 285/276 |
| 3,845,673 | 11/1974 | Karden et al. | 74/751 |

*Primary Examiner*—James L. Jones, Jr.

*Attorney, Agent, or Firm*—Barker, Emch, Schaffer & Todd Co.

[57] ABSTRACT

The invention relates to a pneumatically powered nut runner having an axial swivel interposed the housings of the air motor and gear reducer which permits radial repositioning of the gear reducer housing relative to the air motor housing. A torque reaction bar is affixed to the gear reducer housing and is thus also radially repositionable relative to the air motor housing. This repositioning capability facilitates adjustment of the reaction bar so that it contacts a bracing point without necessitating the radial repositioning of the air motor housing. When torque is applied to a fastener, nearly all reaction torque is taken by the torque bar and none is transmitted to the operator.

12 Claims, 7 Drawing Figures

SWIVEL HEAD REACTION BAR NUT RUNNER

BACKGROUND OF THE INVENTION

Field of the Invention

The invention relates generally to a nut runner having a reaction bar and specifically to a pneumatically powered nut runner having a reaction bar which is rotatable with the gear housing relative to the hand grip housing of the air motor.

Summary of Prior Art

The mass production of consumer goods such as automobiles and trucks has prompted development of a broad range of assembly line tools. The tools are generally air driven and provide power to tighten numerous types of threaded fasteners rapidly and with controlled torque. Since the tightening torque of many fasteners, such as the head bolts on an internal combustion engine is critical, this ability of such tools to do so has gained them wide acceptance.

One drawback of such air powered tools is that the reaction torque generated by the tool (which is equal but opposite to the torque applied to the fastener) is conventionally absorbed by the operator. During a long work shift and in assembly stations where fasteners are tightened to high torque values, operator fatigue often interferes with the application of consistent torque and results in fasteners requiring additional checking and adjustment. Furthermore, operators commonly anticipate the reaction torque from a tool and often give the tool a final "twist" which will apply more torque to the fastener than the torque controlled tools was intended to apply — with sometimes dangerous results or fastener damage.

This difficulty was partially solved by the addition of a reaction bar. This bar is attached to the tool, generally near the nose and is braced against a convenient surface of the product such as the frame or perhaps the engine block. The reduction bar transfers the reaction torque to the object against which is is braced and relieves the operator of absorbing the reaction torque. Furthermore, since the reaction bar will be shaped to brace against one surface, it will normally be always braced against this surface and the fastener will therefore have a highly repeatable and consistent amount of torque applied to it. One example of a reaction bar tool is shown in U.S. Pat. No. 3,845,673.

The reaction bar solution to problems of operator fatigue and inconsistent torque application has one major drawback, however. Of necessity, the reaction bar must be rigidly attached to the tool housing and oriented to function in a given application. The non-adjustability generally impairs or precludes the use of one tool in the assembly of various products having bracing surfaces positioned at differing radial locations relative to the fastener. The only available solutions to this problem were to have several tools at one work station, each with its reaction bar oriented differently for each application or to disassemble the tool, reposition the reaction bar and reassemble the tool. The former solution required the unprofitable expenditure of money, the latter, the unprofitable expenditure of time.

In addition, if a series of differing work pieces is to be torqued by a single tool, even if the torque bar can be accomodated by each piece, the operator may have to operate the tool with its handle and trigger at a different angular position, making his job more difficult and tiring.

SUMMARY OF THE INVENTION

The instant invention is directed to an air powered rotary tool, generally denominated here as a nut runner, having a rotatable gear housing to which the reaction bar is secured. The rotatable housing or nosepiece encloses the gear reduction unit which reduces the speed of the air driven motor from several thousand revolutions per minute to several hundred and produces an inversely proportional increase in torque. Since the speed reducer is in effect the torque generator because it converts a high r.p.m. low torque input into a low r.p.m. high torque output, it is only this mechanism which must be braced in order to prevent the operator of the tool from being subjected to reaction torque. In other words, even though the reaction bar and gear housing are rotatable with respect to the air motor housing and grip, since the speed reducer to which they are attached is, in fact, the source of the torque which must be absorbed, the reaction bar will transfer the reaction torque to the bracing structure and substantially eliminate transfer of reaction torque to the operator. It is clear, however, that the operator will be subjected to the reaction torque of the air motor itself, but this torque will only be the reaction torque of the torque exerted by the high r.p.m. motor on the speed reducer — a relatively inconsequential force — particularly so when compared to the torque delivered by the speed reducer to the fastener.

Therefore, while the reaction torque produced by the speed reducer is transferred to a bracing structure by the reaction bar as it is in conventional prior art devices, the rotatable unit comprising the reaction bar, the speed reducer and the speed reducer housing facilitate the rapid repositioning of the reaction bar relative to the air motor housing and grip to accomodate various product sizes and configurations while providing consistently accurate and repeatable tightening torque.

Thus it is the object of this invention to provide an air powered nut runner having a reaction bar fixed to the speed reducer housing and a swivel joint interposed the air motor and speed reducer housings.

It is a further object of this invention to provide an air powered nut runner having a rotatable reaction bar which will facilitate its use on variously shaped articles of manufacture while providing accurate and consistent tightening torque.

Other objects and advantages will be apparent from the following detailed description of a preferred embodiment of a tool incorporating the invention hereof.

DESCRIPTION OF THE PREFERRED EMBODIMENT

Figure 1:
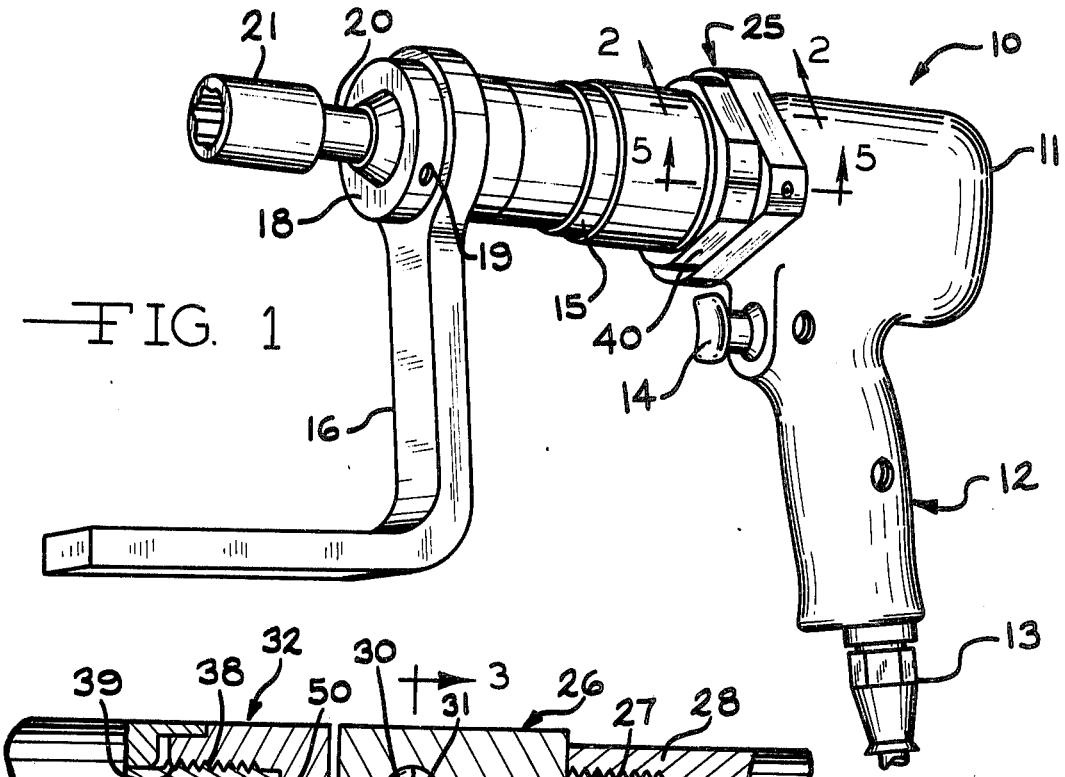
FIG. 1 is a side perspective view of a pneumatic nut runner embodying the instant invention.

An air powered nut runner employing the instant invention is referenced generally by the numeral 10 in FIG. 1. The nut runner 10 includes a housing 11 which encloses and protects an air motor 22. The housing includes a hand grip 12 which is shaped to fit comfortably in the hand of the operator. At the extremity of the grip 12 is an inlet fitting 13 to which a hose supplying compressed air to the tool may be attached. Adjacent the juncture of the housing 11 and the hand grip 12 and positioned to the front of the grip 12 is a push button type trigger 14 which may conveniently be operated with the index finger of the operator. When the trigger 14 is depressed, a valve (not shown) to which it is connected opens and compressed air which entered the nut runner 10 through the inlet fitting 13 is allowed to travel to the air motor 22 within the housing 11 and cause it to rotate.

The nut runner 10 further includes a gear type speed reducer 23 in a cylindrical housing 15. Around the forward periphery of the speed reducer housing 15 is attached a reaction bar 16. The reaction bar 16 may be attached to the speed reducer housing 15 by complimentary teeth on the reaction bar 16 and speed reducer housing 15 forming a spline, matching multi-sided (e.g. hexagonal) surfaces, or any convenient configuration which will inhibit relative rotation between the two structures. A collar 18 attached to the nose of the speed reducer housing 15 by a set screw 19 retains the reaction bar 16 on the speed reducer housing 15. In the alternative, the reaction bar 16 may itself be retained on the speed reducer housing 15 by set screws or other semi-permanent or permanent fastening means. In the embodiment shown, removal of the collar 18 enables an operator to axially move the reaction bar 16 out of its splined engagement, to rotate it to another position and then reinstall it in splined engagement.

An output shaft 20 extends from the forward extremity of the speed reducer housing 15 and is terminated by an interchangeable socket 21 which may typically be a six or twelve sided fitting which engages the nut or fastener to be tightened.

Figure 4:
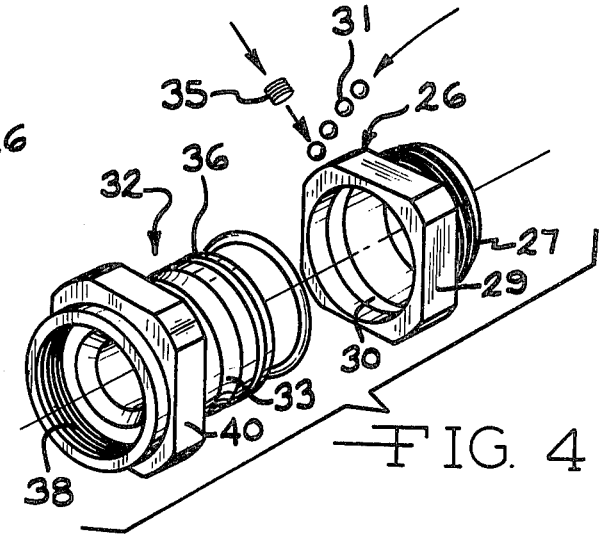
FIG. 4 is an exploded perspective view of the instant invention illustrating the components of the swivel assembly.

Interposed between the air motor housing 11 and the speed reducer housing is a swivel assembly 25. The swivel assembly 25 is shown most clearly in FIGS. 2 and 4. The swivel assembly 25 comprises an outer collar 26, an inner collar 32 and a plurality of ball bearings 31.

The periphery of the outer collar 26 comprises two distinct regions. The end of the collar 26 adjacent the motor housing 11 includes male threads 27 which mate with matching female threads 28 within the motor housing 11. The opposite end of the outer collar 26 includes a plurality of pairs of flatted surfaces 29 (See FIG. 4) which facilitate the assembly and tightening of the outer collar 26 into the motor housing 11. On the inner surface of the outer collar 26 is an annular semi-circular channel 30.

Figure 3:
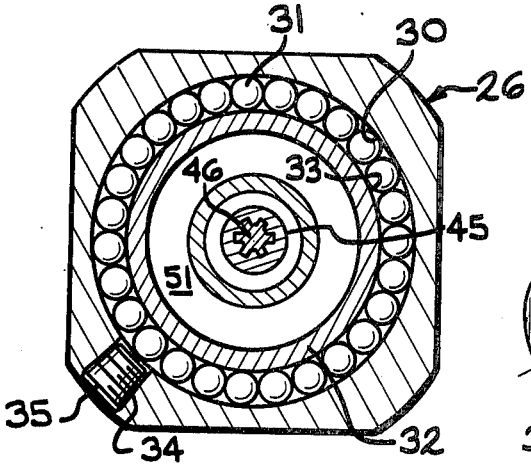
FIG. 3 is a front elevational sectional view of the instant invention taken along line 3—3 of FIG. 2.

Referring now to FIG. 3, the channel 30 functions as the outer retaining structure of a ball bearing race which is filled with a plurality of ball bearings 31. The inner retaining structure of the ball bearing race is an annular semi-circular channel 33 on the outer surface of the inner collar 32. A radially oriented threaded opening 34 in the outer collar 26 intersects the semi-circular channel 30 in the outer collar 26. The opening 34 is sufficiently large to allow the plurality of ball bearings 31 to be loaded into the the ball bearing race defined by semi-circular channels 30 and 33. A threaded plug 35 has external threads which match those in the threaded opening 34, allow the threaded opening 34 to be closed off tightly and semi-permanently and ensure the retention of the plurality of ball bearings 31 within the adjacent semi-circular channels 30 and 31. The head of the threaded plug 35 may include an Allen or spline socket for convenient removal of the threaded plug 35 or a less common head configuration if tampering with the threaded plug is to be discouraged.

The inner collar 32 further includes a second annular channel 36 disposed between the semi-circular channel 33 and the extremity of the inner collar 32 nearest thereto. The channel 36 is of square or rectangular cross-section and retains an O-ring 37. The O-ring 37 seals against the inner wall of the outer collar 26 and provides a fixed amount of resistance to rotation between the two collars 26 and 32. The inner collar 32 also includes internal threads 38 on the end adjacent the speed reducer housing 15. The threads 38 match and engage external threads 39 on the periphery of a cylindrical extension of the speed reducer housing 15. Inner collar 32 further includes a surface comprising a plurality of pairs of flatted surfaces 40 (See FIG. 4) which facilitate the assembly and tightening of inner collar 32 onto the speed reducer housing 15.

The inner collar 32 and the speed reducer housing 15 which is secured thereto by mating threads 38 and 39 is retained in and removeable relative to the outer collar 26 and the air motor housing 11 by the plurality of ball bearings 31 loaded into the aligned semi-circular channels 30 and 33.

It should also be noted that a conventional nut runner which does not utilize the instant invention will, nevertheless, typically include the internal threads 28 on the air motor housing 11 and the external threads 39 on the speed reducer housing 15. In such a device, the air motor housing 11 will be threaded into the speed reducer 15 directly. It is therefore clear that the instant invention may be retrofit on existing equipment simply by unthreading the gear reducer from the air motor and threading the swivel head of the instant invention onto the air motor and gear reducer.

Figure 2:
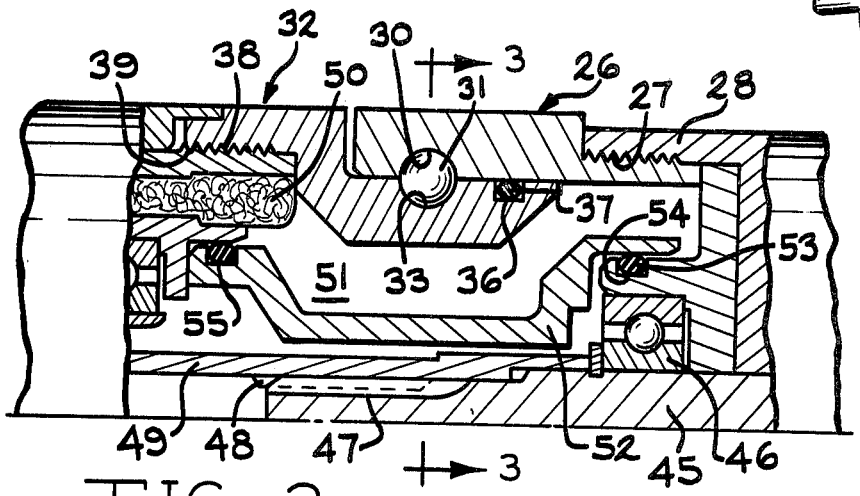
FIG. 2 is a fragmentary side elevational, sectional view of the instant invention taken along line 2—2 of FIG. 1.

The air motor 22 within the air motor housing 11 has an output shaft 45 extending forward of the motor housing 11 and positioned centrally therein. The output shaft 45 may be stabilized and centered by a ball bearing 46 mounted between the shaft 45 and rigid structural members of the air motor housing 11 as illustrated in FIG. 2. Near the terminus of the output shaft 45 is an external spline 47. The external spline 47 mates with an appropriately sized internal spline 48 within an input shaft 49 which transfers power from the air motor output shaft 45 to the speed reducer input shaft 49.

Since the exhaust from the air motor 22 is often loud and annoying to the operator, it is common to muffle the noise by passing the exhaust air through a dampening material 50. The dampening material 50 can be any cellular or random fibrous material such as wire mesh which will not deteriorate under the service conditions and in the atmosphere to which the tool 10 is subjected. Frequently this material and air exhaust ports are located in the speed reducer housing 15, as illustrated, and exhaust air must therefore be routed to the dampening material 50 and exhaust ports 22. An annular passageway 51 communicates between the exhaust ports of the air motor (not shown) and the dampening material 50. The inner surfaces of collars 26 and 32 define the outer periphery of the passageway 51 and the O-ring seal 37 prevents the escape of air from between the adjacent surfaces of the collars 26 and 32. The inner surface of the passageway 51 is defined by a generally cylindrical guide 52 which seats on and seals against an O-ring seal 53 positioned in annular channel 54 in an annular structure within the air motor housing 15. The O-ring seal 53 thus contains the exhaust air within the passageway 51 and also provides a convenient friction mounting for one end of the cylindrical guide 52. The opposite end of the cylindrical guide 52 also contains an annular channel 55 in which a second O-ring seal 56 is positioned. The second O-ring seal 56 also contains the exhaust air within the passageway 51 and provides a convenient friction mounting for the other end of the cylindrical guide 52.

Figure 5:
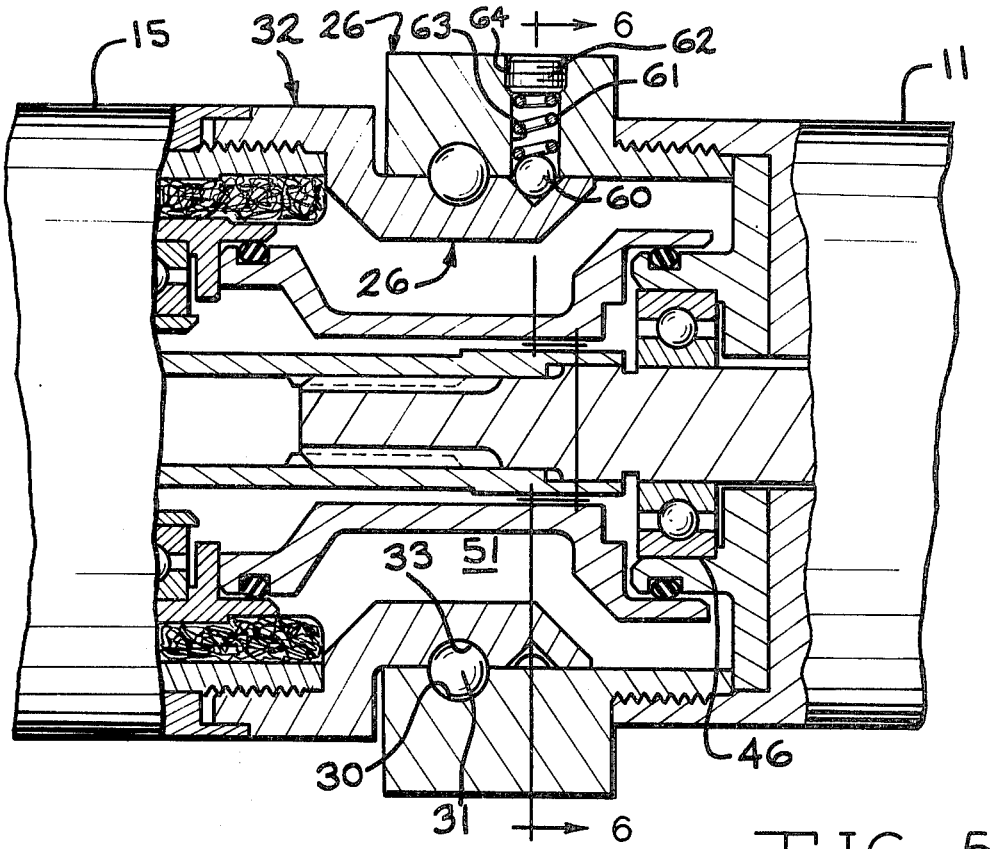
FIG. 5 is a side elevational sectional view of an alternate embodiment of the instant invention, similar to the view of FIG. 2.
Figure 6:
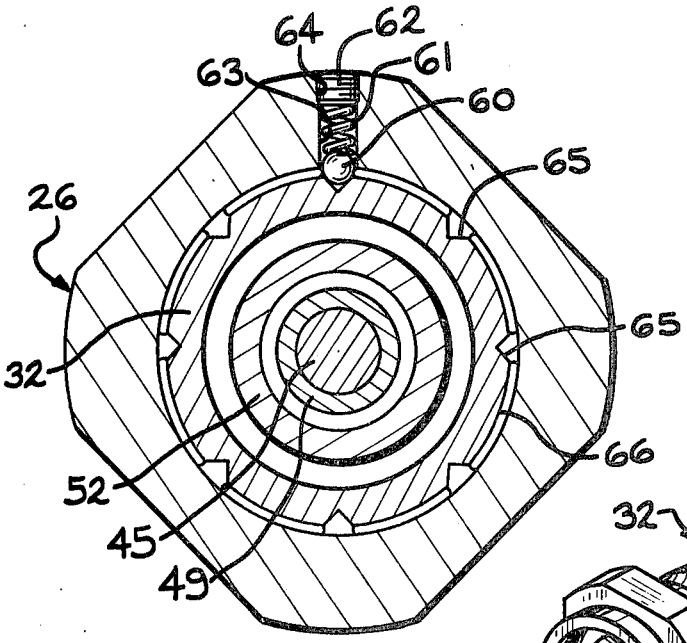
FIG. 6 is a front elevational sectional view of the alternate embodiment of the instant invention taken along line 6—6 of FIG. 5.
Figure 7:
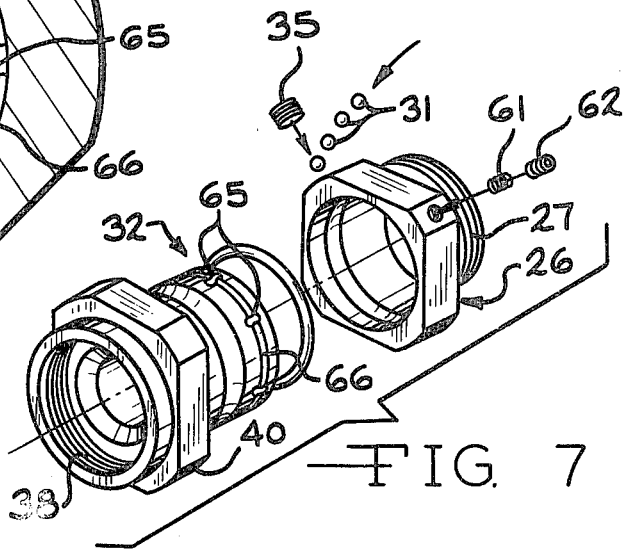
FIG. 7 is an exploded perspective view of the alternate embodiment of the instant invention.
Figure 1:
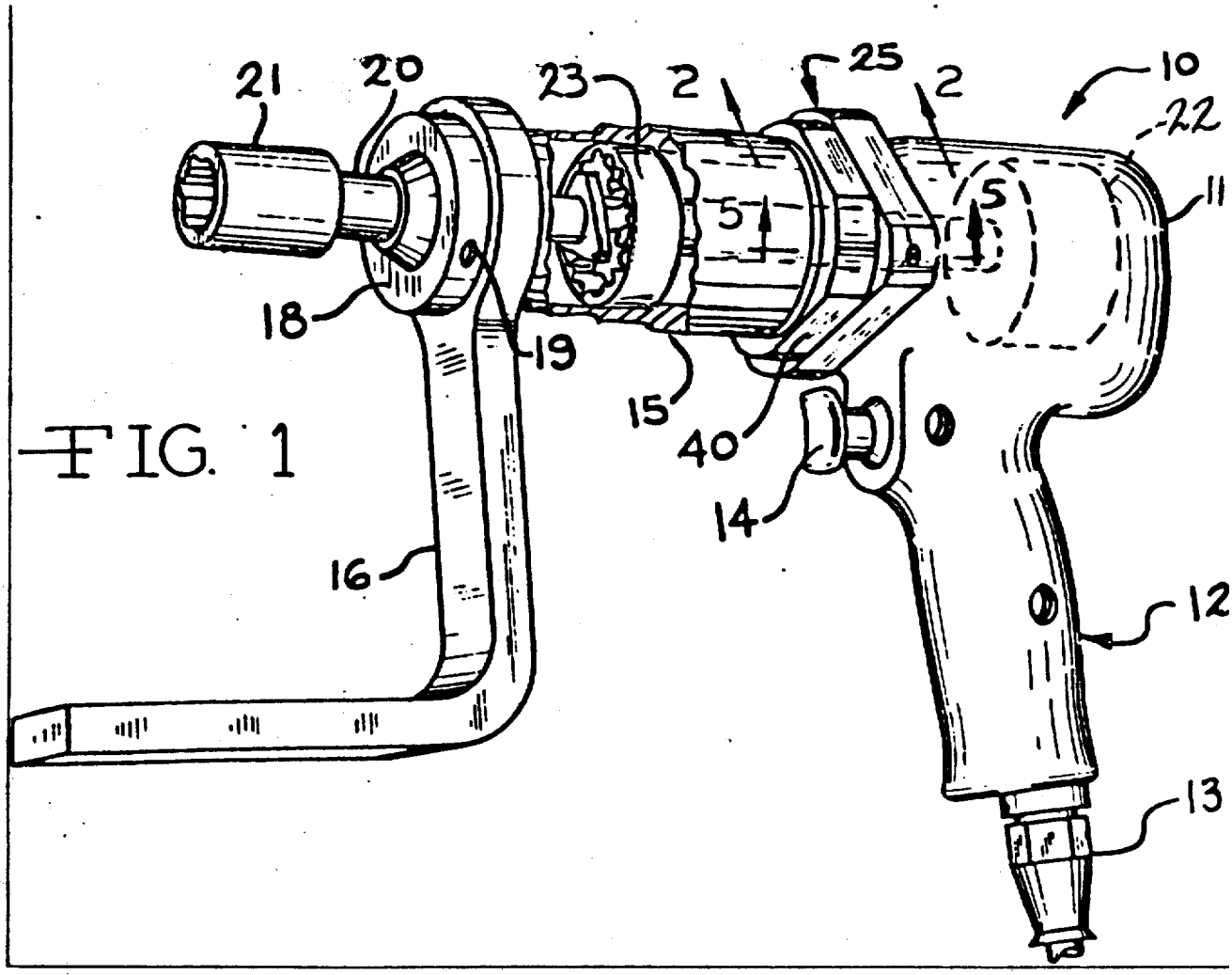

FIGS. 5, 6 and 7 illustrate an alternate embodiment of the tool. In certain applications, the frictional restraining force provided by the O-ring seal 37 (see FIG. 2) may be insufficient to inhibit the rotation of the speed reducer housing 15 and the reaction bar 16. Still other applications may require that the reaction bar 16 be rotated between several known and repeatable positions.

FIG. 5 illustrates a spring-biased detent arrangement, including a ball detent 60, a compression spring 61 and a threaded plug 62 which provides detented rotation of the speed reducer housing 15 relative to the air motor housing 11. The outer collar 26 includes a radially disposed opening 63 having internal threads 64 along the outer portion of its length which match the threads on the threaded plug 62. The ball detent 60 fits within the unthreaded portion of the opening 63 and is biased radially inwardly by the compression spring 61. The threaded plug 62 engages the internal thread 64 of the radial opening 63 and retains the pawl 60 and the spring 61 within the opening 63. The head of the threaded plug 64 may include an Allen or spline to facilitate positive assembly and simplified removal.

The stops or detents are positioned on the inner collar 32 and take the form of a plurality of indentations 65 spaced apart and encircling the outer surface of the inner collar 32 in a channel 66 adjacent the semi-circular channel 33. The longitudinal distance between the center line of the indentations 65 and channel 66 and the center line of the semi-circular channel 33 of the inner collar 32 must, of course, be equal to the longitudinal distance between the center line of the opening 63 and the center line of the semi-circular channel 30 in the outer collar 26. The indentations may be numerous or may be few in number and they may be positioned at spacings of, perhaps, 45° or may be positioned at specific intervals to assist a particular tool application. The depth and profile of the indentations 65 as well as strength of the compression spring 61 and the shape of the end of the ball detent 60 may be varied in accordance with known practice in order to produce the desired detent strength. In operation, the spring-biased detent arrangement provides a positive detent and restricts motion of the air motor housing 11 relative to the speed reducer housing 15 each time the ball detent 60 drops into one of the indentations 65. Increased rotational force between the air motor housing 11 and the speed reducer housing 15 will force the ball detent 60 out of one of the indentations 65 and permit rotation of one housing relative to the other to the next detented position. Notwithstanding the fact that this ball detent alternate embodiment of the nut runner 10 has been described as an alternative to the utilization of an O-ring seal to provide friction between the two housings of the nut runner 10, it should be appreciated that nothing precludes the use of both the ball detent mechanism and the O-ring seal frictional restraint configuration in a nut runner where both steady frictional resistance and positively detented positions of one housing relative to the other are required.

It will be appreciated that various other modifications and changes may be made in the above-described preferred embodiments of the invention without departing from the spirit and the scope of the following claims.

I claim:

1. A tool comprising, in combination, means for generating rotary power having an output shaft, a first housing secured to said rotary power means, a speed reducer having an input shaft connected to the output shaft of said rotary power means and an output shaft connected to a work engaging fitting, a second housing secured to said speed reducer, a reaction bar secured to said second housing and a rotatable interconnection between said first and second housings whereby said first housing and said rotary power means are rotatable relative to said second housing, said reaction bar secured thereto and said speed reducer.

2. The tool of claim 1 wherein said means for generating rotary power comprises a pneumatically powered vane motor.

3. The tool of claim 1 wherein said rotatable interconnection comprises inner and outer nesting collars, one of said collars secured to said first housing, the other of said collars secured to said second housing, said inner collar including a circumferential semi-circular channel on its outer surface, said outer collar including a circumferential semi-circular channel on its inner surface in axial alignment with said semi-circular channel of said inner collar and defining an annulus therewith, and a plurality of ball bearings positioned within said annulus.

4. The tool of claim 1 wherein said rotatable interconnection includes means for frictionally opposing relative rotation between said first and said second housings.

5. The tool of claim 1 wherein said rotatable interconnection includes means for detenting relative rotation between said first and said second housings.

6. The tool of claim 1 wherein said first housing includes a generally radially extending hand grip.

7. An air powered tool comprising, in combination, an air motor having an output shaft, a first housing secured to said air motor, a speed reducer having an input shaft and an output shaft, said input shaft connected to said output shaft of said air motor and said output shaft fitable with means for engaging a fastener, a second housing secured to said speed reducer, a reaction bar secured to said second housing and a rotatable interconnection between said first and said second housings whereby said first housing and said rotary power means are rotatable relative to said second housing, said reaction bar and said speed reducer.

8. The air powered tool of claim 7 wherein said rotatable interconnection comprises inner and outer nesting collars, one of said collars secured to said first housing, the other of said collars secured to said second housing, said inner collar including a circumferential semi-circular channel on its outer surface, said outer collar including a circumferential semi-circular channel on its inner surface in axial alignment with said semi-circular channel of said inner collar and defining an annulus therewith, and a plurality of ball bearings positioned within said annulus.

9. The air powered tool of claim 7 wherein said rotatable interconnection includes means for frictionally opposing relative rotation between said first and said second housings.

10. The air powered tool of claim 7 wherein said rotatable interconnection includes means for detenting relative rotation between said first and said second housings.

11. An air powered tool comprising, in combination, an air motor having an output shaft, a first housing secured to said air motor, a speed reducer having an input shaft and an output shaft, said input shaft connected to said output shaft of said air motor and said output shaft fitable with means for engaging a fastener, a second housing secured to aid speed reducer, a reaction bar secured to said second housing and a rotatable interconnection between said first and said second housings having an axis of rotation coincident with the axes of said output shaft of said air motor and said input shaft of said speed reducer whereby said first housing and said rotary power means are rotatable around said axis of rotation relative to said second housing, said reaction bar and said speed reducer.

12. An air powered tool comprising an air motor having an output shaft, a first housing secured to said air motor, a speed reducer having an input shaft and an output shaft, said input shaft connected to said output shaft of said air motor and said output shaft fitable with means suitable for engaging fasteners, a second housing secured to said speed reducer, a reaction bar secured to said second housing, the improvement comprising a rotatable interconnection between said first and said second housings, said rotatable interconnection including inner and outer nesting collars, one of said collars secured to said first housing, the other of said collars secured to said second housing, said inner collar including a circumferential semi-circular channel on its outer surface, said outer collar including a circumferential semi-circular channel on its inner surface in axial alignment with said semi-circular channel of said inner collar and defining an annulus, whereby said first housing and said air motor are rotatable relative to said second housing, said reaction bar and said speed reducer.

* * * * *

UNITED STATES PATENT AND TRADEMARK OFFICE

CERTIFICATE OF CORRECTION

PATENT NO. : 4,155,278 Page 1 of 2

DATED : May 22, 1979

INVENTOR(S) : Eugene M. Estok

It is certified that error appears in the above—identified patent and that said Letters Patent is hereby corrected as shown below:

Column 1, line 41, "reduction" has been changed to -- reaction --.

Fig. 1 should appear as shown on the attached sheet.

Signed and Sealed this

Nineteenth Day of October 1982

[SEAL]

Attest:

GERALD J. MOSSINGHOFF

Attesting Officer

Commissioner of Patents and Trademarks